United States Patent [19]

Spinner et al.

[11] 4,268,804

[45] May 19, 1981

[54] TRANSMISSION LINE APPARATUS FOR DOMINANT $TE_{11}$ WAVES

[75] Inventors: Georg Spinner, Feldkirchen-Westerham; Leo Treczka, Munich, both of Fed. Rep. of Germany

[73] Assignee: Spinner GmbH, Fed. Rep. of Germany

[21] Appl. No.: 934,180

[22] Filed: Aug. 16, 1978

[30] Foreign Application Priority Data

Aug. 17, 1977 [DE] Fed. Rep. of Germany ..... 2737125
Jan. 9, 1978 [DE] Fed. Rep. of Germany ..... 2800699

[51] Int. Cl.[3] ..... H01P 1/16; H01P 1/161

[52] U.S. Cl. ..... 333/125; 333/239; 333/248; 333/251

[58] Field of Search ..... 333/239, 241, 242, 251, 333/125, 248

[56] References Cited

U.S. PATENT DOCUMENTS

| | | | |
|---|---|---|---|
| 2,210,636 | 8/1940 | Schelkunoff | 333/251 X |
| 2,915,715 | 12/1959 | Young, Jr. | 333/251 X |
| 3,205,462 | 9/1965 | Meinke | 333/239 |
| 3,251,011 | 5/1966 | Unger | 333/251 |
| 3,324,423 | 6/1967 | Webb | 333/251 X |
| 3,364,446 | 1/1968 | Schickle et al. | 333/241 |
| 3,396,350 | 8/1968 | Krank et al. | 333/241 |
| 3,444,487 | 5/1969 | Krank et al. | 333/241 |
| 4,114,121 | 9/1978 | Barlow | 333/251 X |

FOREIGN PATENT DOCUMENTS

| | | | |
|---|---|---|---|
| 1252286 | 10/1967 | Fed. Rep. of Germany | 333/251 |

*Primary Examiner*—Paul L. Gensler
*Attorney, Agent, or Firm*—Lerner, David, Littenberg & Samuel

[57] ABSTRACT

Transmission line apparatus for transmitting TE dominant electromagnetic waves is provided in accordance with the teachings of the present invention. The transmission line apparatus according to the present invention relies upon a transmission waveguide having a uniform cross-section which is substantially larger in dimension than that required for propagation of only the TE dominant electromagnetic wave desired to be transmitted. The transmission waveguide is in fact so large with respect to the transmission frequency for the TE dominant electromagnetic wave selected that a plurality of waves can form and be propagated, however, losses along the waveguide are markedly reduced. The transmission waveguide is provided with guides in the form of structure present in the waveguide which prevents a rotation of the plane of polarization of the TE dominant electromagnetic waves being transmitted. Additionally, according to further aspects of the present invention, coupling structure, which insures that only TE dominant electromagnetic waves are coupled or decoupled from the transmission waveguide are provided. This structure may comprise structure for introducing and receiving signals to be conveyed, structure for matching the boundaries of the transmission waveguide to the introducing or receiving structure and filtering structure to insure that only TE dominant electromagnetic waves are applied to and received from the transmission waveguide.

33 Claims, 22 Drawing Figures

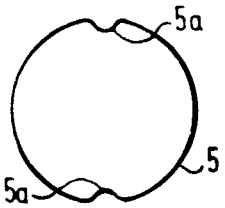
Fig. 13
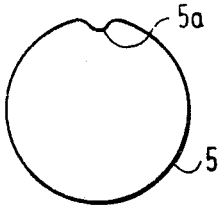
Fig. 14
Fig. 15
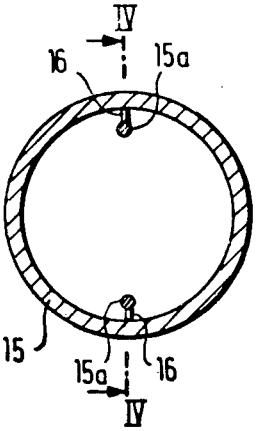
Fig. 16
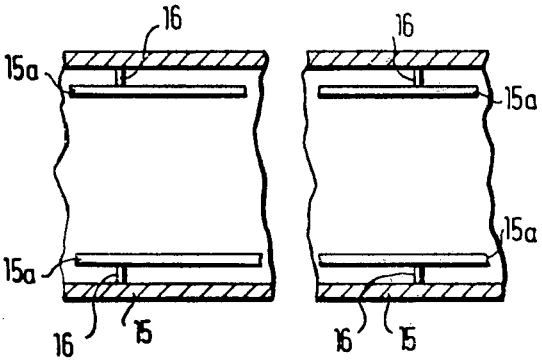
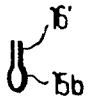
Fig. 17
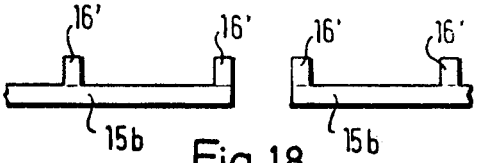
Fig. 18

TRANSMISSION LINE APPARATUS FOR DOMINANT $TE_{11}$ WAVES

The invention relates to a transmission line system comprising a waveguide whose dimensions are so large that a plurality of waveforms can form but which is operated only with the TE dominant wave.

For the transmission of microwave energy various types of waveguide systems are used. The best known are rectangular waveguides which are operated only with the $TE_{10}$ mode or wave, circular waveguides which are operated with TE or TM waves in ranges which may be outside the non-ambiguous region of wave propagation, and square waveguides which are operated with the $TE_{10}$ mode. For the purposes of this disclosure, the non-ambiguous region is defined as that region of operation for a given waveguide wherein the dimensions of the waveguide in relation to the frequency of the signal to be transmitted are such that only one mode can be propagated. Circular waveguides and square waveguides may be operated in these modes with two high-frequency signals of crossed polarization. To keep the attenuation low, in particular in directional radio systems, circular waveguides are used which are operated with either TE or TM modes. The diameter of the waveguides is made substantially greater than for the non-ambiguous range for the desired mode. If the mechanical tolerances of these circular waveguides are kept extremely narrow then the higher modes are practically incapable of self excitation or at least occur only with very low amplitude. However, each discontinuity of the transmission line excites higher modes and thus increases the attentuation. Furthermore, even where narrow tolerances are employed such discontinuities will occur in any case at the excitation point, i.e. the coupling points where energy is input or output from the waveguide. A particular disadvantage of the circular waveguides is that on transmission of the $TE_{11}$ waves with crossed polarization, the irregularities of the tube result in polarization rotations which are greatly dependent on frequency and where polarization rotation occurs between the two signals crosstalk results.

Therefore it is a principal object of this invention to provide a waveguide transmission line system wherein the requirements for high tolerances placed on the individual transmission system waveguides is significantly reduced.

This problem is solved by the invention set forth in claim 1.

Further advantages of the waveguide transmission line system according to the present invention are set forth in the other claims. More particularly, by shaping the transmission line system in the manner defined by the claims, the requirements placed on the dimension and shape of the transmission waveguide with respect to accuracy can be diminished without giving rise to the danger of a rotation of the polarization of the wave propagating through the waveguide.

Transmission line systems according to the present invention are especially suitable for the transmission of high frequency or very high frequency energy, but can also be used for waveguides intended for operation at wavelengths in the microwave-centimeter or very high frequency-meter ranges.

Previously, only rectangular waveguides operated in the $TE_{10}$ mode have been utilized for this range of wavelengths. A rectangular waveguide, for example for the frequency 200 MHz requires for example dimensions of $1.0 \times 0.5$ m. However, it is exceptionally difficult to manufacture such large waveguides with sufficient geometrical precision and also provide sufficient mechanical stability.

Cost factors alone are sufficient to prevent the wall thickness of such a waveguide from being scaled up to a size equivalent to the wall thicknesses of the smaller waveguides used at higher frequencies and thus large waveguides of this kind tend to be mechanically unstable.

In an attempt to overcome this problem, large waveguides of this kind have been made from relatively thin, light alloy sheets which sometimes incorporate stiffening ribs and/or sandwich construction. These construction techniques have not, however, provided useful because simply filling such a waveguide with dry air, even at the lowest pressure differential, leads to an unacceptable mechanical deformation of the waveguide. The use of circular sectional waveguides which are preferable from a mechanical standpoint is not possible for the $TE_{10}$ ($TE_{11}$) modes of operation because inaccuracies result in a rotation of the plane of polarization and hence a high degree of crosstalk.

In accordance with a preferred form of the invention, waveguide apparatus is provided having a circular configuration with at least one guide means projecting into the hollow space. In accordance with another form of the invention two guide means are provided within the inventive waveguide apparatus, displaced by 180°, relative to a common axis for the simultaneous transmission of two waves in the system, the waveguide being preferably formed by a tube having a circular cross-section which is provided with four guide means disposed at intervals of 90° about a common axis. In this way four guide surfaces are formed which are disposed at 90° to each other so that, in a limiting case, waveguide apparatus according to the instant invention may be configured to have a square cross-section.

The form of the waveguide apparatus employed in a transmission line system in accordance with the instant invention makes it possible to use circular cross-section waveguides which can be made in simple fashion and exhibit greater mechanical stability than waveguides having a rectangular cross-section without having to place severe requirements on dimensional accuracy. The provision of at least one guide means within a waveguide according to the present invention ensures that the E-vector is always properly propagated through the waveguide and the use of waveguides exhibiting a circular cross-section adds low attenuation characteristics to the resulting invention.

Transmission errors associated with discontinuities due to stress do not occur even if excessive pressure occurs in the interior portions of the waveguide or if the same is subjected to external mechanical loads so that it is finally possible to manufacture a waveguide having a circular cross-section with significantly tighter tolerance than would be possible for a rectangular waveguide. The guide means can be provided by longitudinally extending a deformed wall portion of the waveguide or separate guide means in the form of webs, ribs or ridges may be formed of conducting material. Moreover the guide means may also be formed by correspondingly shaped conducting strips appropriately secured to the inner wall of the waveguide, or by strips or ribs of dielectric material.

The guide means need only project into the cavity of the waveguide sufficiently to prevent rotation of the E-vector which would otherwise occur due to irregularities in the cross-section of the waveguide tube.

An advantageous technique for manufacturing the waveguide tube is to spirally wind a strip of material to form the tube while welding together adjacent edges thereof. For high frequencies, however, it is preferable to use square waveguides. Square waveguides have long been used for propagating waveforms having transversely polarized fields because the square configuration substantially prevents mutual rotation of the field vectors which results in a mixing of the signals and crosstalk. However, square waveguides have heretofore always been operated only in the ambiguous range for the wave to be propagated whereas the waveguides employed in the transmission system according to the present invention are dimensioned in a manner which no longer guarantees a well defined range for the wave being propagated. Although such operating conditions have been previously used in conjunction with circular waveguides, the design of the transmission line system according to the instant invention has the advantage that the attenuation is considerably smaller than that exhibited by circular waveguides of the same dimensions and problems associated with elliptical deformation and vector rotation in the waveguide are avoided.

According to a preferred embodiment of the invention, coupling to the transmission waveguide is accomplished through circular waveguides having diameters which guarantee a well defined waveform and the subsequent transition transformaton from this circular waveguide to a transmission waveguide not having a well defined range is established by circular transformation jumps.

Preferably mode barriers are incorporated at the beginning and at the end of the transmission waveguide according to the present invention to suppress extraneous waveforms excited by the circular transformation so that only the desired wave is transmitted through the transmission waveguide.

These mode barriers or mode filters are preferably arranged within a waveguide section whose dimensions permit the appearance of the TM-mode but suppresses higher TE-modes.

A gradually widening waveguide section is arranged after the waveguide section incorporating the mode filters or barriers which results in a matching to the dimensions of the transmission line waveguide. In this manner matching of the transmission line waveguide to the coupling section, both from the mechanical and electrical standpoint is simply achieved without undue expense.

The mode filters, in accordance with one embodiment of the invention, have internal line portions disposed in alignment with the axis of the transmission waveguide and insulated therefrom by insulating supports arranged at intervals of $\frac{1}{4}$ of the waveguide-wavelength.

The internal line portions, in accordance with one embodiment of the invention, are made of insulating material which may be provided with a coating of resistive material through vapour deposition techniques or the like so that an undesired wave is attenuated and not short circuited. In this way the bandwidth of the transmission system is increased.

Due to the shape of the transmission waveguide tube, in accordance with the invention, equalization and removal of rotation in polarization caused by dimensional irregularities of the waveguide tube may be achieved by a diagonal deformation of the waveguide tube.

The invention will be explained in detail hereinafter with reference to the preferred embodiments illustrated in the drawings, wherein.

Figure 7:
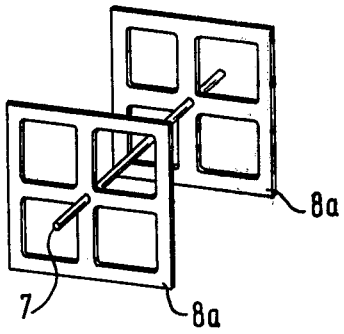
Figure 7A:
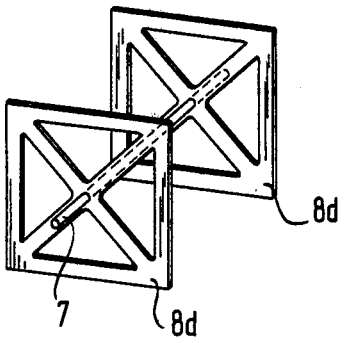

FIGS. 7 and 7*a* illustrate preferred embodiments of the mode filters of the coupling-in system in accordance with the teachings of the present invention;

FIGS. 8 to 11 illustrate the internal cross-section of embodiments of the transmission waveguides according to the present invention operated outside nonambiguous transmission range;

FIGS. 12*a*–12*d* illustrate embodiments of insulating supports for internal line portions of the mode filters;

FIG. 13 illustrates the internal cross-section of an embodiment of a waveguide in accordance with the teachings of the present invention;

FIG. 14 illustrates the internal cross-section of a further embodiment of a waveguide in accordance with the teachings of the present invention;

FIG. 15 illustrates an internal cross-section of yet another embodiment of a waveguide;

FIG. 16 shows a longitudinal section of the embodiment of the invention shown in FIG. 15, taken along the line IV—IV;

FIG. 17 illustrates the cross-section of a conducting web for the embodiment of the waveguides shown in FIGS. 15 and 16; and FIG. 18 is a side view of a conducting web whose cross-section is shown in FIG. 17 for a waveguide in accordance with the embodiments of this invention shown in FIGS. 15 and 16.

Figure 1:
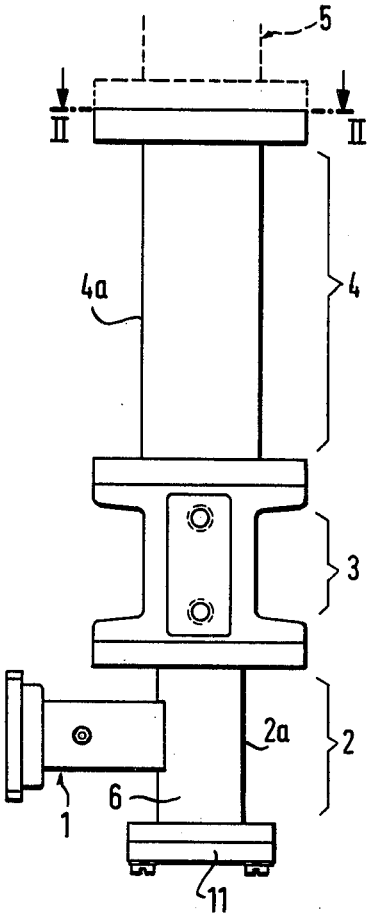
FIG. 1 is a side view of an embodiment of the coupling system for a transmission waveguide operated outside the non-ambiguous transmission range.
Figure 3:
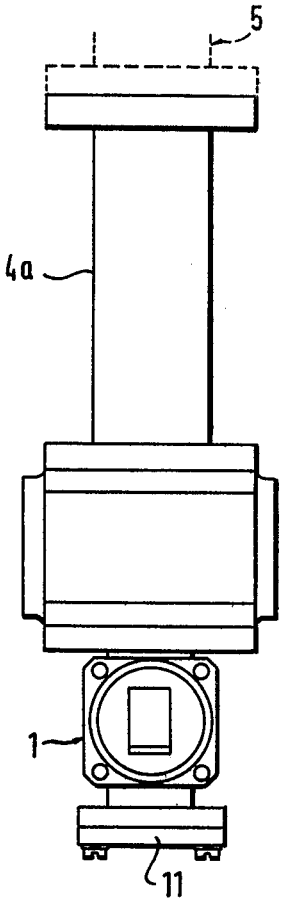
FIG. 3 is a side view of FIG. 1.
Figure 2:
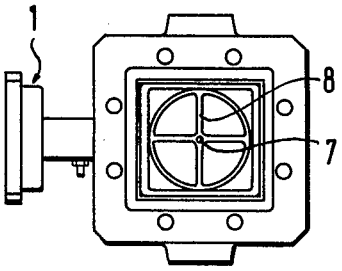
FIG. 2 is a top view taken through line II—II in the direction of the arrows of FIG. 1.

FIGS. 1 to 3 show a first embodiment of a coupling system for a transmission waveguide operated outside the non-ambiguous range and having a cross-section symmetrical about two perpendicular planes. The transmission waveguide 5 may for example take the form of an internationally standardized Q61 waveguide which has hitherto only been used for a defined frequency range in the region of 6 Gc/s. However, it should be noted that in the present case this waveguide is to be utilized for a frequency range of 11.6 to 13.25 Gc/s.

Considered generally, the coupling/system illustrated in FIGS. 1–3 comprises a coupling portion 2, a transformation portion 3, and a mode filter 4. The coupling portion includes a circular waveguide 2*a* which is operated in a non-ambiguous range. The waveguide 2*a* receives high-frequency energy from a rectangular waveguide 1 which is also operated in a defined frequency range for that waveguide. To enable the coupling portion 2 to be operated in a mode for propagation of a single waveform and for the transmission of two polarized waves it is provided with an open end remote from the transformation portion 3. For propagation of a single waveform the open end may be closed by a plate 11 as shown. For the transmission of two polarized waves, a further coupling section 10, as indicated for example in FIG. 4, may be connected at this location.

Figure 4:
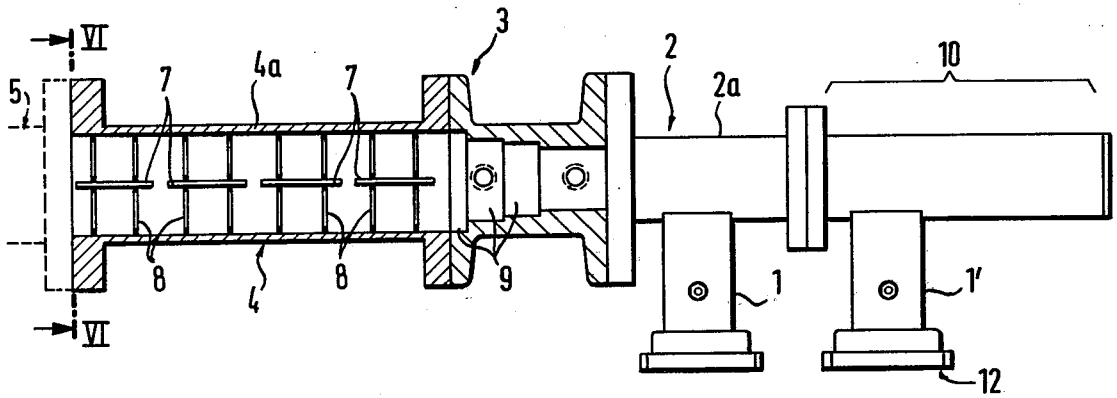
FIG. 4 is a further embodiment of the coupling system according to the present invention for propagating two transversely polarized waves.

The transformation portion 3 as shown in greater detail in FIG. 4, comprises a plurality of concentrically disposed cylindrical portions of increasing diameter which permit adaptation of the wave being propagated in the circular waveguide 2*a* of the coupling portion 2 for application to the mode filter 4 or to the transmission of waveguide 5.

The mode filter comprises internal lines 7, also shown in greater detail in FIG. 4, which are mounted with the aid of insulating supports 8 in the interior of the waveguide tube 4*a* of the mode filter 4. The waveguide tube 4*a* of the mode filter 4 may have the same internal cross-section as the following transmission line and acts to suppress undesired modes so that the same are not applied to the transmission waveguide 5.

Since it is desired to propagate the TE 11 mode, the TM mode may also be tolerated as far as the dimensions of the waveguide 4*a* are concerned as it may be readily suppressed by internal elements. The higher TE modes such as TE 12 etc. should be suppressed by the design of the waveguide 4*a*. For this reason, the waveguide tube 4*a* of the mode filter is preferably dimensioned so that the TM-mode is allowed to occur but higher TE-modes, i.e., above TE-11 are suppressed.

FIGS. 2, 6 and 7 and 12*a* and 12*b* show various configurations of insulating supports for the lines 7. In the embodiments of the insulating supports illustrated in FIGS. 2, 6 and 7 said supports comprise four struts which are at right-angles to each other and lie in the direction of the E-vector of the field to be transmitted.

For many applications it is however preferred, that the webs and struts of the insulating supports for the lines 7 be installed, as far as possible, in the field free space inside the waveguide.

Figure 12A:
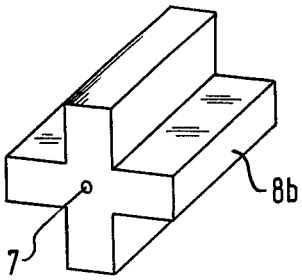
Figure 12B:
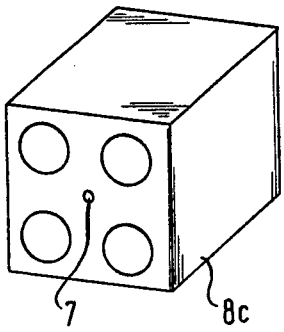
Figure 12C:
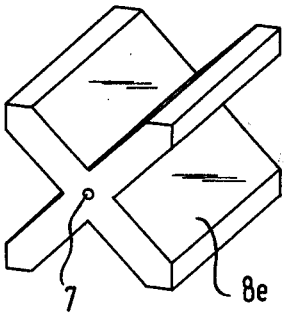
Figure 12D:
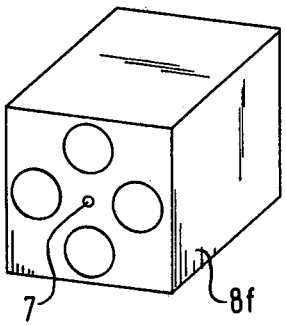

Embodiments illustrating this form of installation are shown in the FIGS. 7*a*, 12*c* and 12*d* which correspond respectively to FIG. 7, 12*a* and 12*b*. In the embodiment illustrated in FIG. 7*a*, the four struts are arranged at right angles to each other and diagonally to the outer border of the insulating support 8*d*. FIG. 12*c* illustrates an insulating support 8*e* in which the ends of the four plate like webs are beveled so that they can be inserted into a waveguide tube with the webs aligned with the diagonals thereof. Similarly in FIG. 12*d* the regions 8*f* of the insulating material support disposed about the recesses are arranged to lie diagonally so that in each case the insulating material supports lie at an angle of 45° to the direction of the E-vector of the field to be transmitted.

Figure 6:
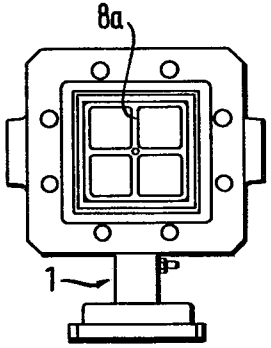
FIG. 6 is a side view of the embodiments shown in FIG. 4 taken through line VI—VI.

The lines 7 have a length which corresponds to one-half the wavelength of the waves to be transmitted while insulating supports shown in FIGS. 2, 6 and 7 are spaced apart at intervals corresponding to a quarter wavelength of the TE wave to be transmitted. A further improvement in the suppression of undesired field modes may be obtained by spacing lines 7, end to end, at $\frac{1}{4}$ of the wavelength of an undesired wave.

The lines 7 can advantageously be made from insulating material and be coated with a resistive material by vapour deposition techniques or the like. The resistive material preferably has thickness which is less than the depth of penetration so that the disturbing mode is attenuated. In this manner, the bandwidth of the transmission system may be increased.

The amount of material used for the insulating supports 8 should be kept as small as possible to minimize unwanted influences upon the high-frequency field.

The mode filter preferably includes, in the manner indicated in FIG. 4, four lines 7 which are disposed in series as illustrated. The individual lines 7 are provided with insulating supports 8 which may be injection moulded about the lines 7 in the manner indicated in FIGS. 7 and 7*a*, so that the assemblies thus formed can easily be inserted into the waveguide tube 4*a*.

Alternatively, assemblies of components of the type shown in FIG. 12*a* to 12*d* may also be used. In the embodiments of FIG. 12*a* and 12*c*, the line 7 is embedded in a structure of foam material which has a length corresponding to $\frac{1}{2}$ of the wavelength of the TE wave to be transmitted.

The foam bodies 8*b* and 8*e* of FIGS. 12*a* and 12*c* have a cross-like cross-section, and axial cutouts may also be provided in the webs of this cross-section.

In the embodiment of FIGS. 12*b* and 12*d* a foam body 8*c* or 8*f* have a square cross-section is shown and may be provided with recesses made as large as possible to reduce the amount of material needed. Both the embodiments of FIGS. 12*a* and 12*b* are provided with recesses at points which lie on the diagonal of the waveguide tube while in the embodiments of FIG. 12*c* and 12*d* cut outs are arranged in the direction of the electric field so that a reduction in attenuation results.

In addition, the foam material body of the first component in the mode filter 4, adjacent to the transformation section 3, may be provided with an extension to improve and simplify wave translation.

In each case the first of the four mode filter components illustrated is closely fitted to the transformation section (preferably with a spacing of less than $\frac{1}{4}$ of the TM wavelength to be suppressed internally by waveguide 4*a*) and this spacing can be used for compensation and improvement of the transition transformation. When the line is made of electrically insulating material coated with a resistive material through vapour deposition techniques or the like, it is possible to construct the mode filter with a single continuous line of a length substantially equal to an integral multiple of the half wavelength of the wave to be transmitted.

FIGS. 8 to 11 illustrate, in cross-section, various, preferred internal configurations for the transmission waveguide 5 according to the teachings of the present invention. The transmission waveguide 5 may preferably be pressed in the continuous manner from soft metal, e.g. soft aluminum, and the wall thickness configuration of said waveguide tube may be so designed that the internal cross-section is not deformed upon a bending of the waveguide tube.

On the other hand it is possible to design the wall thickness configuration to compensate for field distortions which normally occur in a curved waveguide section due to deformations in the cross-section.

Figure 8:
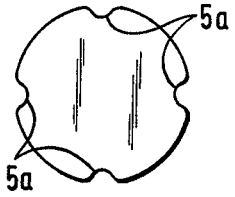

The internal cross-section illustrated in FIG. 8 comprises a generally circular form with four indentations 5*a* offset with respect to each other by 90°. This reduces erroneous polarization rotation of the transmitted wave so that it is possible to transmit independent waves with good decoupling within the transmission waveguide.

Figure 9:
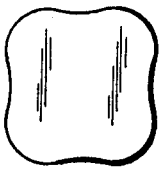
Figure 11:
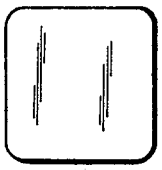

The internal cross-section illustrated in FIG. 11 is generally square with rounded corners. The embodiment illustrated in FIG. 9 is similar to that illustrated in FIG. 11 except the side faces are drawn inwardly and curved.

Figure 10:
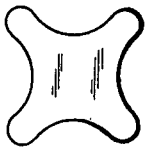

A further advantageous cross-sectional form is shown in FIG. 10. Here the side faces of the cross-section illustrated in FIG. 11 are drawn inwardly in a more pronounced manner than shown in FIG. 9.

Figure 5:
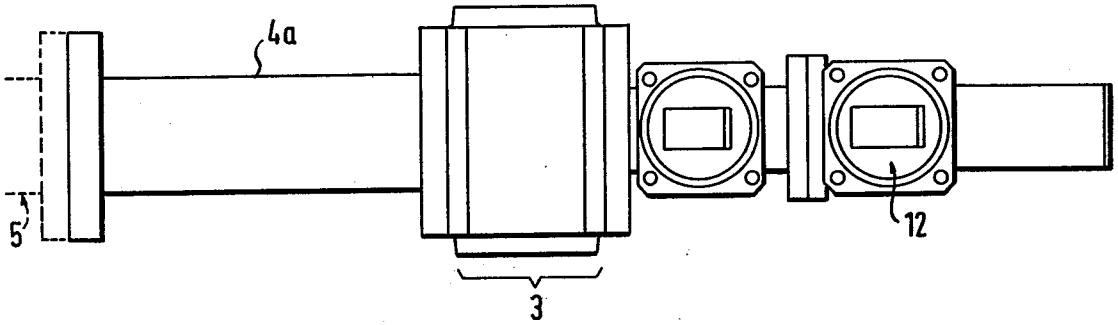
FIG. 5 is a partially sectioned top view of the embodiment of the invention illustrated in FIG. 4.

Whereas the embodiment of the coupling portion illustrated in FIGS. 1 to 3 is intended only for the feeding and transmission of a single wave, in the embodiment of the invention shown in FIGS. 4 to 6 a different form of the coupling portion enables two waves to be simultaneously coupled to or decoupled from the waveguide 5. In this connection it is pointed out that the coupling system disposed at the other end of the transmission waveguide 5 is made in the same manner as that to the right of axis VI—VI so that a symmetrical arrangement with the transmission waveguide 5 in the centre results. The coupling arrangement shown in FIGS. 4–6 corresponds to that shown in FIGS. 1–3 except that the coupling portion 2 illustrated in FIG. 1 is closed by a closure member 11; in the embodiment (of FIGS. 4–6) the closing member 11 is removed and a further coupling portion 10 is added for the coupling of a second wave to be propagated.

A further embodiment for an internal cross-section of a hollow waveguide 5 in accordance with the teachings of the present invention is illustrated in FIG. 13. Here two inwardly projecting indentations 5*a* are provided to form the guide means. The indentations are displaced by 180° from each other relative to the axis of the waveguide and extend along the axial direction of the waveguide.

In FIG. 14 there is shown a further embodiment of waveguide structure for the transmisstion system according to the present invention wherein only a single indentation 5*a* extending along the axial direction of the waveguide 5 is employed. This single indentation suffices to prevent a rotation of the position of the E-vector which might be caused by geometrical variations in the dimension and shape of the waveguide tube and/or other factors which might tend to bring about such a rotation of the E-vector.

This embodiment is especially suitable for the transmission of a single signal.

In the embodiment illustrated in FIGS. 15 and 16 a circular waveguide 5 is provided with webs 15*a* arranged about the inner wall thereof. Each web is connected to the inner wall by a conducting pedestal 16. The conducting pedestal 16 are arranged and spaced apart along the longitudinal direction of the waveguide tube by a distance equal at most to a quarter of the wavelength of the wave to be transmitted. It is possible for these conducting webs to be made in short sections, the mutual separation of which, in the longitudinal direction, is preferably smaller than 1/20th of the wavelength while the length of the individual web sections should not be greater than one half of the wavelength.

FIG. 15 shows these conducting webs 15*a* with a round cross-section however, it is also possible to use other cross-sectional shapes.

Furthermore it is possible to use correspondingly shaped sheet sections or sheet metal strips, the central portions of which project into the wavequide, in place of the webs or web section previously illustrated.

It is also possible to use only a single web instead of the two webs displaced by 180° as illustrated in the embodiment of FIGS. 15 and 16.

It is also possible to replace the conducting web 15*a* with strips or ribs of dielectric material which can also serve as guide means.

FIGS. 17 and 18 show a further version of a conducting web 15*b* which could, for example be used instead of the webs of FIGS. 15 and 16. The webs 15*b* illustrated in FIGS. 17 and 18 are formed together with their pedestals 16′ in one piece from sheet metal strips which have been bent back on themselves so that the portions forming the pedestals are pressed together in pairs.

Moreover FIG. 18, which is not to scale, shows an arrangement of two web sections which do not abut but are separated by an appropriate interval.

Another advantageous embodiment of the invention is to form a circular waveguide from a spirally wound and welded band so that waveguide sections of any desired length can be manufactured without difficulty. The width of the spirally wound and welded band, as viewed in the axial direction of the waveguide, is preferably a quarter of the desired operating wavelength or an odd multiple thereof.

It is also possible to use angled plates to change the direction of the transmission system. Under these circumstances a plate may be arranged at right angles to the bisector of the angle between adjacent waveguide sections. The plate does not, in its own right, have any additional guide means or function. Instead the guiding of the wave is accomplished by means of the waveguide means of adjacent waveguide sections. For "T" and branching sections and also for transitions to a coaxial line it is possible to discontinue the waveguide means within a section and instead to compensate for the resulting discontinuity produced within these sections themselves.

If it should be necessary to effect a transition from the circular waveguide with waveguide means to a rectangular waveguide, then preferably a relatively short guide section having a different cross-section may be introduced between the two waveguide configurations. The wave bounding surfaces of this relatively short guide section may be formed by transverse metal walls which are arranged perpendicular to the axis of the waveguide.

We claim:

1. Transmission line apparatus for transmitting dominant TE-11 electromagnetic waves comprising:

a transmission waveguide having an elongated tubular configuration disposed about a central longitudinal axis and a substantially uniform cross-section throughout, said uniform cross-section of said waveguide being symmetrical about at least one passing through said central longitudinal axis and being substantially larger in dimension than is optimum for transmitting only TE-11 electromagnetic radiation to the extent that other modes can be propagated therethrough, said elongated tubular configuration of said transmission waveguide having a continuous periphery formed of conductive material for conveying said TE-11 electromagnetic waves and guide means for preventing a rotation of the plane of polarization of TE-11 electromagnetic waves transmitted through said transmission waveguide;

waveguide coupling means for supplying TE electromagnetic waves to said transmission waveguide, said waveguide coupling means being of substantially different dimension than said transmission waveguide and including a waveguide tube for receiving high frequency energy to be transmitted, said waveguide tube being dimensioned in relation to said high frequency energy to enable only TE mode waves to propagate therein;

wave transformation means interposed between said waveguide coupling means and said transmission waveguide for conveying TE electromagnetic waves therebetween, said wave transformation means including a short waveguide section of increasing cross-sectional dimension having walls defining bounding surfaces for the wave being conveyed, said short waveguide section being configured to define bounding surfaces for the wave being conveyed which vary in dimension from the dimension of said waveguide coupling means to an effective dimension for said transmission waveguide to enable appropriate wave translation therebetween for said wave being conveyed; and mode filter means disposed intermediate said waveguide coupling means and said transmission waveguide.

2. The transmission line apparatus according to claim 1 wherein said uniform cross-section is substantially square and exhibits rounded corners.

3. The transmission line apparatus according to claim 1 wherein said elongated tubular configuration is formed by a continuous extrusion of relatively soft metal.

4. The transmission line apparatus according to claim 1 wherein said short waveguide section is formed of a plurality of waveguide portions of increasing cross-sectional dimension interconnected in a stepwise graduated manner.

5. The transmission line apparatus according to claim 1 wherein said uniform cross-section takes a form resulting from a square whose corners have been rounded and whose side walls intermediate said corners have been provided with corresponding, curvilinear, symmetrical indentations.

6. The transmission line apparatus according to claim 5 wherein said symmetrical indentations correspond to a substantial length of arc of a circle.

7. The transmission line apparatus according to claim 1 wherein said uniform cross-section is substantially circular, said elongated tubular configuration taking the form of a cylindrical tube having a continuous peripheral wall for conveying TE dominant electromagnetic waves and said guide means projecting from said continuous peripheral wall toward said central longitudinal axis.

8. The transmission line apparatus according to claim 7 wherein said guide means takes the form of a groove in said peripheral wall of said transmission waveguide, said groove being disposed in parallel with said central longitudinal axis and having a well defined trough projecting into said interior of said cylindrical tube.

9. The transmission line apparatus according to claim 7 wherein said guide means take the form of strips of dielectric material.

10. The transmission line apparatus according to claim 7 wherein said cylindrical tube takes the form of a helically coiled and welded strip, said strip having a width measured in the axial direction of said cylindrical tube corresponding to an odd multiple of a quarter wavelengths of the wave to be propagated.

11. The transmission line apparatus according to claim 7 wherein said guide means takes the form of a plurality of indentations in said continuous peripheral wall of said transmission waveguide, said plurality of indentations projecting into the interior of said cylindrical tube toward said central longitudinal axis and disposed in parallel therewith.

12. The transmission line apparatus according to claim 11 wherein each of said plurality of indentations takes the form of a groove in said peripheral wall of said transmission waveguide, each groove being disposed in parallel to said central longitudinal axis and having a well defined trough projecting into said interior of said cylindrical tube, and said grooves forming said plurality of indentations being arranged equidistantly from adjacent grooves about said periphery of said cylindrical tube.

13. The transmission line apparatus according to claim 12 wherein said plurality of indentations take the form of two parallel grooves disposed opposite one another in said peripheral wall of said transmission waveguide.

14. The transmission line apparatus according to claim 12 wherein said plurality of indentations take the form of four parallel grooves disposed at 90° intervals about the peripheral wall of said transmission waveguide.

15. The transmission line apparatus according to claim 13 or 14 wherein said uniform cross-section of said transmission waveguide is also symmetrical about a second plane passing through said central longitudinal axis, said second plane being perpendicular to said at least first plane.

16. The transmission line apparatus according to claim 7 wherein said guide means takes the form of conductive webs disposed within said transmission waveguide, each of said webs being mechanically and electrically connected to said peripheral wall of said transmission waveguide by pedestal means fixedly disposed therebetween.

17. The transmission line apparatus according to claim 16 wherein at least a pair of said conductive webs are disposed in parallel upon opposed portions of said peripheral wall.

18. The transmission line apparatus according to claim 16 wherein said conductive webs take the form of short sections disposed in a longitudinal direction along said peripheral wall, each section being no longer than approximately one-half the length of the wavelength of the wave to be propagated and sections within a single line of webs being spaced end-to-end by a distance no greater than approximately one-twentieth of the wavelength of the wave to be propagated.

19. The transmission line apparatus according to claim 16 wherein said pedestal means contact only small portions of the area of said conductive webs and said peripheral wall.

20. The transmission line apparatus according to claim 19 wherein said webs have a circular cross-section.

21. The transmission line apparatus according to claim 1 wherein said mode filter means is dimensioned to prevent formation of TE electromagnetic waves of higher order than said TE dominent electronic wave.

22. The transmission line apparatus according to claim 21 wherein said dimensions of said filter means may permit a formation of TM electromagnetic waves and said filter means includes means for suppressing TM electromagnetic waves which form.

23. The transmission line apparatus according to claim 21 wherein said mode filter means is disposed intermediate said wave transformation means and said transmission waveguide.

24. The transmission line apparatus according to claim 23 wherein said mode filter means takes the form of a filtering waveguide having a peripheral wall and a continuous internal line portion disposed along the central axis thereof, said continuous internal line portion having a length corresponding substantially to an integral multiple of one-half the wavelength of the wave to be transmitted, and said continuous internal line portion being formed of insulating material having a coating of resistive material deposited thereon.

25. The transmission line apparatus according to claim 23 wherein said mode filter means takes the form of a filtering waveguide having a peripheral wall and line portions disposed along the central axis thereof, said line portions being mounted to said peripheral wall of said filtering waveguide by insulating support means and said insulating support means being spaced by a quarter of a wavelength of waves to be transmitted.

26. The transmission line apparatus according to claim 25 wherein said line portions have a length corresponding to one-half the wavelength of waves to be transmitted.

27. The transmission line apparatus according to claim 25 wherein said insulating support means comprises a foam support corresponding in length to one-half the wavelength of waves to be transmitted, said foam support having axial recesses located at positions along the E-vector of the wave to be transmitted.

28. The transmission line apparatus according to claim 25 wherein said insulating support means comprises insulating supports having four struts disposed at an angle of 45° to the E-vector of the field to be transmitted.

29. The transmission line apparatus according to claim 25 wherein a first of said line portions disposed along said central axis has a leading edge portion thereof disposed as closely as possible to said wave transformation means and the spacing thereof from said transformation means is adjusted to suppress waveforms other than that which is desired to be propagated in said transmission waveguide.

30. The transmission line apparatus according to claim 25 wherein each of said line portions are formed of insulating material having resistive material deposited thereon.

31. The transmission line apparatus according to claim 1 additionally comprising:

waveguide decoupling means for receiving TE electromagnetic waves from said transmission waveguide, said waveguide decoupling means including a waveguide tube for conveying high frequency energy, said waveguide tube being dimensioned in relation to said high frequency energy to enable only TE mode waves to be propagated therein;

decoupling wave transformation means interposed between said waveguide decoupling means and said transmission waveguide for conveying TE electromagnetic waves therebetween; and decoupling mode filter means disposed intermediate said decoupling wave tansformation means and said transmission waveguide for suppressing TE electromagnetic waves of a higher order than TE-11.

32. The transmission line apparatus according to claim 31 wherein said waveguide coupling means receives two independent signals to be transmitted from first and second rectangular waveguides having standard configurations, said independent signals having polarizations spaced at 90°.

33. The transmission line apparatus according to claim 31 wherein said waveguide coupling means comprises a waveguide tube having a circular configuration and is provided with an aperture at a portion thereof remote from said wave transformation means, said aperture being normally closed by aperture plate means overlying said aperture.

* * * * *

UNITED STATES PATENT AND TRADEMARK OFFICE

CERTIFICATE OF CORRECTION

PATENT NO. : 4,268,804

DATED : May 19, 1981

INVENTOR(S) : GEORG SPINNER et al

It is certified that error appears in the above-identified patent and that said Letters Patent are hereby corrected as shown below:

Column 2, line 17, "provided" should read --proved--.
Column 6, line 21, "have" should read --having--.
Column 8, line 49, after "one" the word --plane-- should be inserted.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*